US006463754B1

(12) United States Patent
Matesanz

(10) Patent No.: US 6,463,754 B1
(45) Date of Patent: Oct. 15, 2002

(54) CLIMATE CONTROL CABINET

(76) Inventor: Victoriano Alarcia Matesanz, Segundo Anca, 2, 28023 Madrid (ES)

( * ) Notice: Subject to any disclaimer, the term of this patent is extended or adjusted under 35 U.S.C. 154(b) by 0 days.

(21) Appl. No.: 09/719,332

(22) PCT Filed: Jun. 11, 1999

(86) PCT No.: PCT/ES99/00176

§ 371 (c)(1),
(2), (4) Date: Feb. 21, 2001

(87) PCT Pub. No.: WO99/66272

PCT Pub. Date: Dec. 23, 1999

(30) Foreign Application Priority Data

Jun. 12, 1998 (ES) ..... 9801242

(51) Int. Cl.[7] ..... F25D 17/04; F02B 21/02
(52) U.S. Cl. ..... 62/417; 62/3.6
(58) Field of Search ..... 62/3.6, 407, 419, 62/417, 465, 62

(56) References Cited

U.S. PATENT DOCUMENTS 3,500,649 A * 3/1970 Feldman ..... 62/3.6
4,364,234 A * 12/1982 Reed ..... 62/3.6
4,739,886 A * 4/1988 Seaberg
4,795,038 A * 1/1989 Johnson
5,215,208 A * 6/1993 Jackson
5,848,534 A * 12/1998 Stauffer

FOREIGN PATENT DOCUMENTS

EP 66005 A1 * 12/1982
GB 2229352 A * 9/1990

* cited by examiner

*Primary Examiner*—Chen-Wen Jiang
(74) *Attorney, Agent, or Firm*—Katten Muchin Zavis Rosenman

(57) ABSTRACT

A climate control device has constituent walls of sandwich type construction with insulating element inside. As an option for a refrigeration element, a Peltier cell is place inside. On the rear wall of the inside is a part which is subdivided into different individual parts between which are slots to allow circulation of air. The parts are provided with a set of orifices, preferably arranged in quincunxes and adapted so that the necks of bottles may be loosely inserted in them. The device is particularly suited for containing wines and sparkling wines at a stable temperature.

4 Claims, 2 Drawing Sheets

CLIMATE CONTROL CABINET

OBJECT OF THE INVENTION

The present object of the invention relates as stated in its title to a climate control device which is particularly suited to refrigeration of all types of bottles, such as wine, bubbly wine as cava, champagne, or similar.

BACKGROUND OF THE INVENTION

It is well known that conservation of wine, cava, champagne or any similar products requires stable temperature conditions and stillness, alteration of which conditions reduces the quality of the wine stored due to acceleration of ageing or oxidation processes.

It is equally well known that the storage and conservation temperature for red wines is approximately between 13 ° C. and 16° C. such ideal conservation conditions being found in wine cellars. whose great advantage derives from their stable year-round temperatures.

Conservation of other types of wine, such as white wines, champagne or cava is substantially different from that of red wines and they must thus be conserved and stored at substantially lower temperatures, which cannot be obtained in natural caves or cellars, and which must be obtained artificially by using refrigerators not specifically designed to contain these products, but which are also meant for other functions such as conserving food. soft drinks, etc.

Likewise, it has been observed that storage of wine in wine cellars is not ideal for their conservation, firstly because the standard arrangement of the bottles is to stack them, so that labels are difficult to see, resulting in the types of wine, years, etc. not being known, and secondly because placing the bottle horizontally causes the cork to soak and thus it does not breathe, causing over time a loss in the quality of the product contained in the bottle.

German Patent DE-4 233 172 is known that relates to a temperature control device made up by a cooling producing element made by a PELTIER cell that convey by transmission its temperature to a metallic piece and thereafter to the bottle which comes into contact with said piece, the cooling or heating conveyance to the bottle been effected by transmission and in individual manner.

European Patent EP-0 066 005 is also known that relates to a bottle exhibitor that permits the fastening of the bottle through its neck and in an inclined manner.

DESCRIPTION OF THE INVENTION

In order to solve these problems it is proposed that a set of goals must be met which tend to improve storage and conservation conditions of the wines during lengthy periods of time without altering their conservation conditions.

The primary object of the invention is to constitute a climate control device and container for such products as wines, bubbly wines as champagne or cava and similar wines, etc. This cupboard must as a first requirement be provided with well insulated walls so that its interior will not be affected by variations in the outside temperature. For this purpose a sandwich type construction has been adopted, consisting of internal and external walls, which are visible, and with a noble wood finish, without prejudice of any other finish, with a sufficiently thick insulation panel provided between these walls, so that the coefficient of thermal transmission at the walls of said container is very small.

This type of insulation is also provided in the front access doors of the cupboard, which shall also have this sandwich type configuration.

The insulating material parts are placed in the inside of this sandwich type construction in a non-rigid manner, avoiding a rigid attachment or gluing, since thermal expansions due to outside temperature changes would cause a rupture of the outer part or at least cracks to appear, thus considerably affecting the insulation performance of the climate control device.

In order to refrigerate the inside of the climate control device has been chosen a Peltier cell system, widely known in the state of the art, with the cooling faces of said cells placed in the inside of the cupboard, thus refrigerating it, with the opposite face where heat is produced being provided with means for dissipating such heat, aided or not by the corresponding fan which forces air to pass through said dissipater and therefore causing the cooling of the Peltier cell.

Similarly to what takes place in the heat dissipation face, the inside of the cupboard may be provided with on or more fans which even out the temperature of the container, preventing the air inside from remaining static and so considerable temperature differences from appearing, although the design of this device is so optimised that these temperature differences would not likely appear inside-said device.

In order to control the temperature, a thermostat is provided inside the closet which can be adjusted at will by the user, which allows to keep the temperature constant as preset by the user, from a temperature of only a few degrees Celsius for white or sparkling wines such as cava or champagne, to higher temperatures around 13° C. or 16° C. for red wines, or even at higher temperatures.

The bottles are arranged so that their labels can be seen perfectly, set in quincunxes. Likewise, each bottle remains independent of the rest by their individual location inside the closet or bottle rack, joining the bottle necks to the rack so that the rack consists of a set of orifices placed in quincunxes with a diameter slightly greater than that of the necks of the bottles. This arrangement also ensures that due to this slight clearance the bottle rests with an inclination of approximately 5°, so that the wine or content. of the bottle partially impregnates the cork leaving another part of the cork dry. so that it can be aired.

In order to aid a better distribution of the temperature inside the volume, upon placing the aforementioned bottle rack between the volume itself and the Peltier cooling cell, the bottle set is divided into independent partitions with large enough separations between them to allow air to circulate between them.

Each component part of the bottle container, although adapted to contain any number of bottles has been preferably arranged as two rows, providing 23orifices so that two dozen bottles, in other words two cases adding up to twenty-four bottles can be stored, save one bottle which would be used to sample the lot. As natural, the arrangement of the bottles is adjusted to the size of the climate control device.

Although rows are mentioned these could equally be columns, in other words the individual parts may be placed vertically, with no effect on the make up of the aforementioned device or on the conservation of the bottles.

In locations where the local climate allows, or when the cupboard is to be placed in a site which eliminates the need for the Peltier cell cooling system, it may be eliminated, provided the ambient temperature is stable and suitable for the wine to be contained.

DESCRIPTION OF THE FIGURES

Further characteristics of the present invention will become apparent in view of the accompanying drawings where the following is shown.

DESCRIPTION OF THE DRAWINGS

Figure 1:
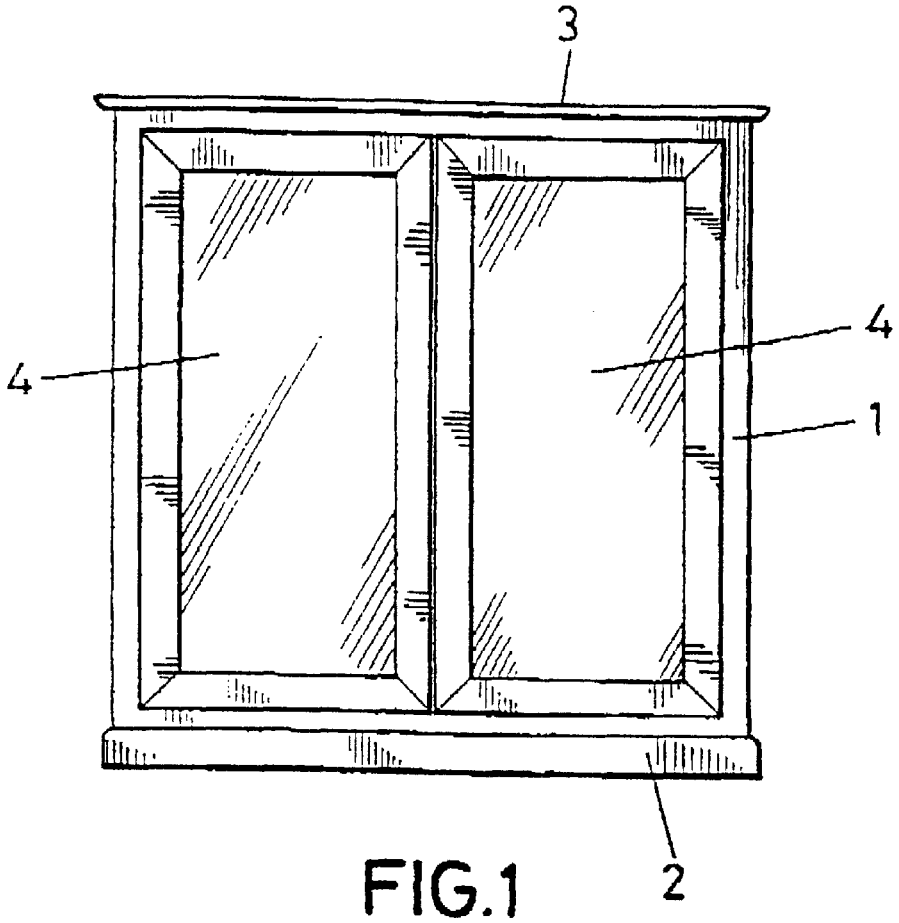
FIG. 1 shows a representation of the front side of the cupboard, showing the access doors for the device in question as well as its pleasant appearance, which may be that of a traditional cupboard.

FIG. 1 shows a climate control device (1) which, as seen, may assume any whichever appearance, in this example that of a traditional wooden cupboard, with a base or pedestal (2), a top base (3) and front access doors (4) to the inside of the cupboard, with the corresponding traditional inlaid. It should be stressed that this cupboard may assume any shape, including such ones as a vat or cask, or any other one preferred.

Figure 2:
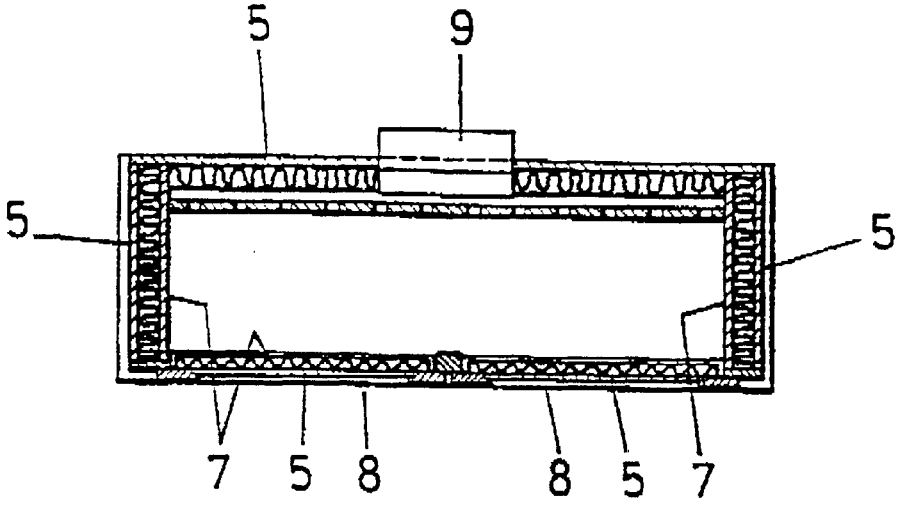
FIG. 2 shows a sectional view where the more relevant construction features of the device can be appreciated.

FIG. 2 shows a sectional view of this same device (1) in which its side walls and doors have a sandwich-type construction with outer parts (5) and inner a parts which may be made of wood, plastic or any other material which is to assume the finished appearance, and inside which is placed a layer, sheet or portion of insulating material which fully insulates the interior of the compartment from the temperature changes of the outside. Doors (8) provide a perfect seal of the inside of the compartment.

In the rear of the device is placed the cooling system, here a Peltier cell (9) with its cold-generating side facing inwards in contact with the cupboard. In order to provide a proper and even distribution of the cold inside the compartment, one or more fans may be provided which achieve a uniform temperature inside, these fans not shown in the accompanying drawings. At position (10) is shown the bottle rack, which is provided with a set of orifices (11) distributed in quincunxes the make-up and distribution of which may be seen in greater detail in FIG. 3 where part (12) can be seen subdivided into small parts between which are left slots to allow air to pass in order to achieve an even distribution of the air inside the device or container.

Figure 4:
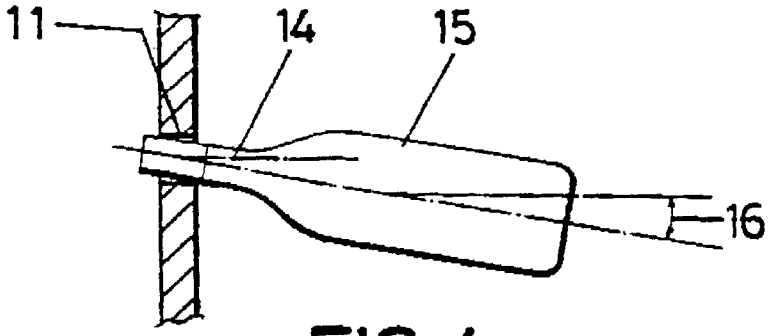
FIG. 4 represents a sectional view of a bottle placed in the rack, as well as the ideal position which the former assumes.

Each of these parts is provided with orifices (11) through which the necks of the bottles are inserted as shown in detail in FIG. 4, where the clearance provided in the orifice (11) allows neck (14) of bottle (15) to form an angle to the horizontal, allowing the cork to be partially impregnated by the liquid contained in the bottle, allowing it to breathe and become oxygenated.

Returning to FIG. 3, the distribution of each individual part as two rows of orifices can be appreciated, with up to 23 orifices in each part, which number is ideal to place 23 of the 24 bottles of two cases of 12 bottles, with the extra one used to sample the lot.

A further element not shown in the drawings is the thermostat placed inside the compartment of device (1) which allows that once the temperature is set by the user the Peltier cell will start or not until the desired temperature is obtained.

Figure 3:
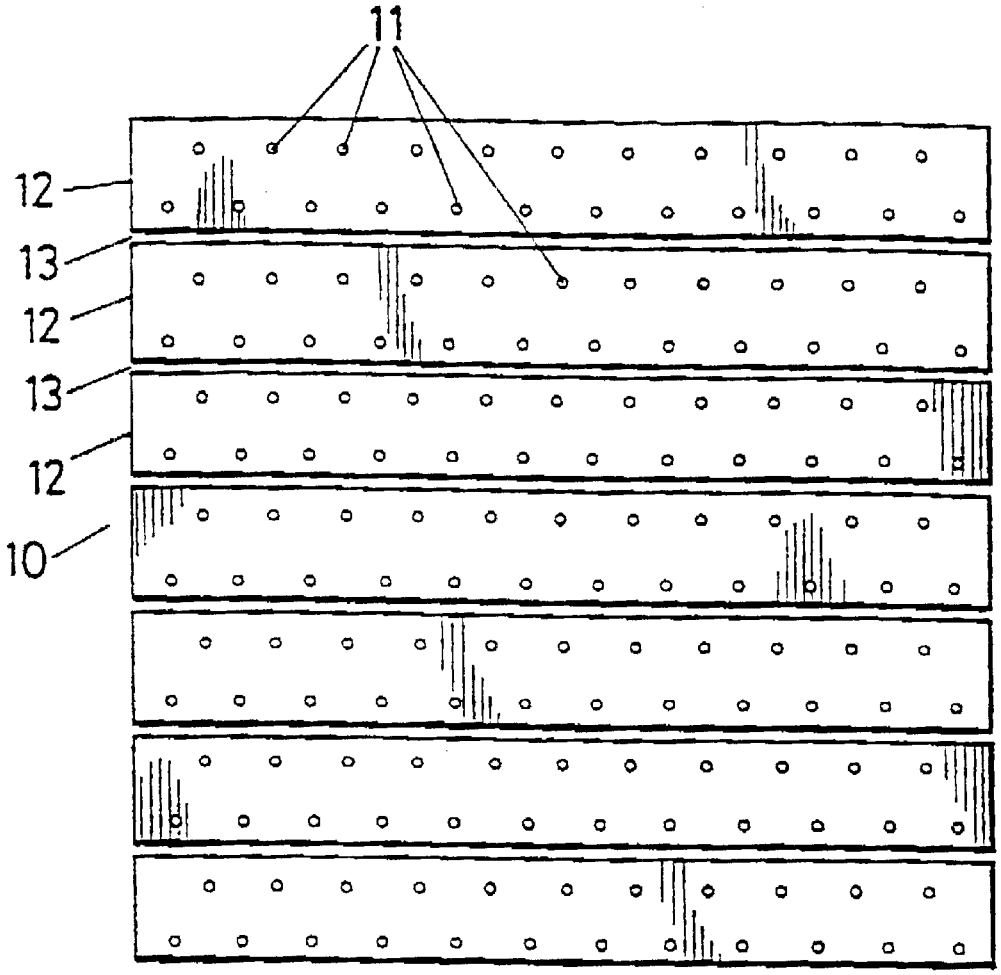
FIG. 3 shows a front detail of the parts which make up a bottle rack.

The arrangement of the bottle supporting parts may be indifferently horizontal, as shown in FIG. 3, or vertical.

What is claimed is:

1. A climate control device for keeping contents therein at stable temperature conditions, said device, comprising:

sandwich-type construction walls with insulating elements therein;

a refrigeration element comprising Peltier cells placed close and parallel to an inside rear wall of the device;

a contents rack subdivided into different individual parts provided with a set of orifices preferably arranged in quincunxes and adapted to insert the necks of the contents loosely and the device operates in an air to air system.

2. A climate control device as in claim 1, wherein said contents are bottles and wherein the bottle necks are placed inside wide orifices so that the bottle axis forms an angle to the horizontal, causing the liquid inside it to be in partial contact with the sealing cork thus allowing its oxygenation.

3. A climate control device as in claim 1 wherein each individual part is provided with 23 orifices placed in quincunxes.

4. A climate control device as in claim 1, wherein each individual part has any number of orifices placed in quincunxes depending on the cabinet dimensions and power of the cooling units.

* * * * *